United States Patent [19]

Rubinstein

[11] Patent Number: 4,643,693

[45] Date of Patent: Feb. 17, 1987

[54] ORNAMENTAL OR AMUSEMENT DEVICE

[76] Inventor: Edna Rubinstein, 25 Hahistadrut Street, Givatayim, Israel

[21] Appl. No.: 701,862

[22] Filed: Feb. 14, 1985

[30] Foreign Application Priority Data

Mar. 2, 1984 [IL] Israel ..... 71130

[51] Int. Cl.[4] ..... A47G 33/00

[52] U.S. Cl. ..... 446/267; D11/70; 40/406; 428/3; 428/11; 428/13

[58] Field of Search ..... 428/3, 11, 13; 272/8 N; 446/267; D11/70, 121, 141; 40/406, 538, 539; 273/1 L, 145 B, 145 C, 145 CA

[56] References Cited

U.S. PATENT DOCUMENTS

| | | | |
|---|---|---|---|
| D. 270,525 | 9/1983 | Bayusik | 428/11 X |
| 2,440,205 | 4/1948 | McLain | 428/13 X |
| 2,451,913 | 10/1948 | Brice | 428/13 X |
| 2,452,730 | 11/1948 | Carter | 273/145 C |
| 2,590,279 | 3/1952 | Soss | 428/13 X |
| 3,105,457 | 10/1963 | Krueger | 428/11 X |
| 3,225,805 | 12/1965 | Wise | 428/13 X |
| 3,463,624 | 8/1969 | Labino | 428/13 X |
| 3,613,265 | 10/1971 | Stern et al. | 428/13 X |
| 3,944,691 | 3/1976 | Smith | 428/13 |
| 4,049,277 | 9/1977 | Carlsson, Jr. et al. | 273/1 L X |
| 4,362,299 | 12/1982 | Suzuki | 273/1 L |
| 4,496,155 | 1/1985 | Goldfarb | 273/153 S |
| 4,554,189 | 11/1985 | Marshall | 428/11 |

*Primary Examiner*—Henry F. Epstein
*Attorney, Agent, or Firm*—Benjamin J. Barish

[57] ABSTRACT

An ornamental or amusement device has the geometric configuration of two inter-penetrating tetrahedra including eight apices and presenting the appearance of a six-pointed star when viewed along the axis of any one of the eight apices. In one described embodiment, the body is disposed within a transparent housing filled with a transparent liquid, the body having a density different from that of the liquid such that it slowly moves from one end to the opposite end of the housing when inverted. In a second described embodiment, the body is enclosed by a housing having a plurality of planar faces to permit the geometric body to stably rest in any position on a flat horizontal surface.

6 Claims, 5 Drawing Figures

FIG. 1
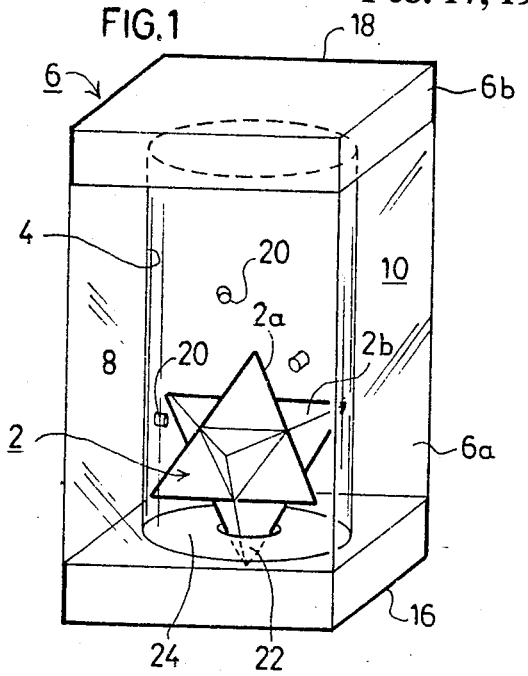
FIG. 2
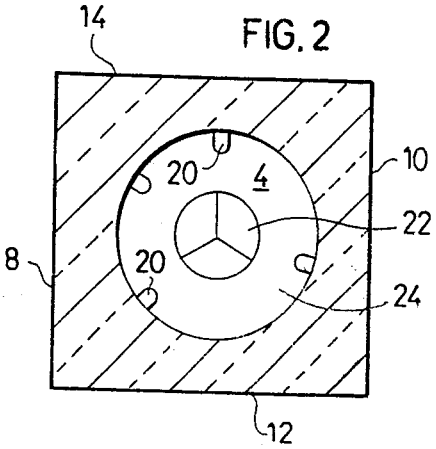
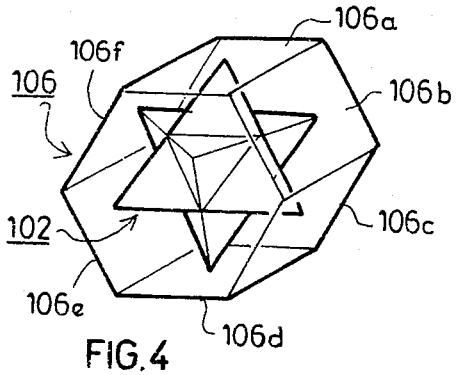
FIG. 4
FIG 3
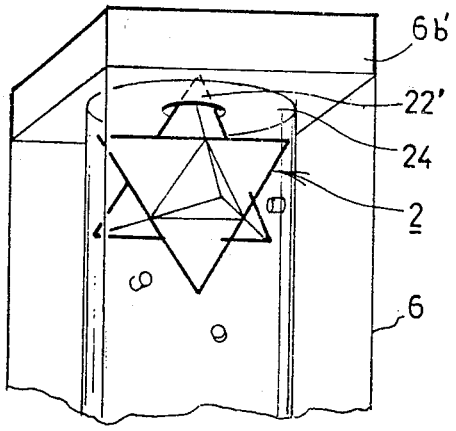
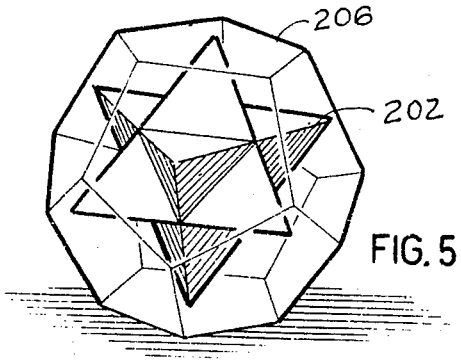
FIG. 5

ORNAMENTAL OR AMUSEMENT DEVICE

BACKGROUND OF THE INVENTION

The present invention relates to an ornamental or amusement device, and particularly one that can be manipulated by the user for ornamental or amusement purposes.

SUMMARY OF THE INVENTION

According to a broad aspect of the present invention, there is provided an ornamental or amusement device, comprising: a housing formed with a closed internal chamber adapted to extend in the vertical direction when the housing is supported in an upright position; at least one side of the housing being transparent to permit viewing of the chamber; the chamber being filled with a transparent liquid; a body disposed within the chamber and having a geometrical configuration including an apex projecting from each of a plurality of sides of the body; the housing at one end of the chamber being formed with a recess corresponding to the shape of the apex; the body having a density different from that of the liquid such that inverting the housing from its upright position causes the body to move through the liquid away from the one end of the chamber, and then returning the housing to its upright position causes the body to move through the liquid back towards the one end of the chamber until one of the apices of the body is received within the recess formed in the one end of the chamber for orienting the body with respect to the transparent side of the housing.

In the preferred embodiment of the invention described below, the body has the geometric configuration of two inter-penetrating tetrahedra including 8 apices and presenting the appearance of a 6-pointed star when viewed along the axis of any one of the 8 apices; also, the body has a density greater than that of the liquid, such that in the normal upright position of the housing the body rests on the chamber bottom, the recess being formed in this bottom end of the housing.

It will thus be seen that when such a device is inverted and then returned to its normal upright position, the geometric body will first move away from the chamber bottom and then will descend back towards the chamber bottom, its movements being dampened by the liquid until one of the 8 apices of the body is received within the recess at the chamber bottom, whereupon the body will present the appearance of a 6-pointed star when viewed along the axis of the apex viewable through the transparent side of the housing. Each side of the geometric body can be differently colored such that the aim of manipulating the device would be to cause the body to settle to the bottom in a position displaying a predetermined color. Alternatively, each side of the body could carry a different message, which messages would be selectively displayed according to which side of the body is viewed through the transparent side of the housing. Many other variations are possible.

According to another aspect of the invention, the geometric body is disposed within a housing having a plurality of planar faces. Thus, the housing could have eight planar faces, each perpendicular to the axis through each of the eight apices of the geometric body; or it could have more than eight planar faces to permit the geometric body to stably rest on a horizontal surface in any position.

Further features and advantages of the invention will be apparent from the description below.

The invention is herein described, by way of examply only, with reference to the accompanying drawings, wherein:

BRIEF DESCRIPTION OF THE DRAWINGS

FIG. 1 is a three-dimensional view illustrating one form of device constructed in accordance with the present invention;

FIG. 2 is a transverse section along lines II—II of FIG. 1, but with the body removed from its internal chamber;

FIG. 3 is a fragmentary view illustrating a modification; and

FIGS. 4 and 5 illustrate further variations of the invention

DESCRIPTION OF PREFERRED EMBODIMENTS

Reference is first made to the construction of the geometric body, generally designated 2, illustrated in FIG. 1. Body 2 is of a known geometric configuration and includes two inter-penetrating tetrahedra 2*a*, 2*b*. Such a geometrical configuration is illustrated, for example, in the book "The Magic Mirror of M. C. Esches", published by Ballantine Books, Division of Random-House, Inc., 1976, page 94. One of the interesting characteristics of this geometric configuration is that it includes 8 apices, each having a smaller tetrahedron configuration, which together present the appearance of a 6-pointed star when viewed along the axis of any one of the 8 apices.

The device illustrated in FIG. 1 includes the geometric body 2 illustrated in FIG. 3 disposed within a closed, internal chamber 4 formed in a housing 6. Chamber 4 is illustrated as being of cylindrical shape, whereas the outer configuration of housing 6 is shown as being of right-square, prismatic shape. The housing 6 may be conveniently manufactured from plastic by injection-molding the lower section 6*a* to form the cylindrical chamber 4, and then closing the top of the chamber by an upper section in the form of a solid plastic plate 6*b*.

Before chamber 4 is closed, it is filled with a liquid, such as an oil or water, and the geometric body 2 is then disposed within the chamber 4. The upper housing section 6*b* may then be bonded to the lower housing section 6*a* so as to seal chamber 4 against the entry of air, and against the exit of liquid.

At least one side of housing 6 is transparent to enable viewing the internal chamber 4 and the geometric body 2 disposed within it. Preferably, the complete housing is made of transparent plastic material so that body 2 can be viewed from all sides. Another variation is to make the complete housing of transparent plastic material, but to render the opposite side walls 8 and 10 translucent, whereas the front and rear walls 12 and 14 are retained transparent to permit viewing from either the front or rear of the housing. Both the bottom wall 16 and the top wall 18 have outer faces which are flat to permit the housing to be stably supported in either its upright position or in an inverted position on a flat horizontal surface such as a table.

In the FIG. 1 embodiment, geometric body 2 is formed of a material having a higher density than that of the liquid within chamber 4, so that the body sinks within the liquid to the bottom. Thus inverting the housing from the upright position illustrated in FIG. 1 will cause the body 2 to move away from the chamber bottom towards the top housing section 6*b*, and returning the housing to its normal upright position will cause the body to descend by gravity back towards the chamber bottom. At both times, the movement of the body 2 is dampened by the liquid within the chamber 4, the degree of dampening being dependent upon the difference between the density of the body with respect to the liquid within the chamber.

Chamber 4 is of a diameter which is larger than the largest dimension of the geometric body 2, and is of a height substantially larger than the largest dimension of the geometric body. Preferably, the height of chamber 4 should be at least two or three times the largest dimension of body 2.

Housing 6 is further formed with a plurality of projections 20 protruding slightly into chamber 4 so as to be engageable by body 2 during its movement away from the chamber bottom while the housing is in its inverted position, or back towards the chamber bottom when the housing is returned to its normal upright position. These projections thus apply turning moments to the body causing it to tumble during these movements.

The bottom of housing 6 is formed with a recess 22 corresponding to the tetrahedron shape of the apices of body 2, so that when the body descends to the bottom, one of its apices will be received within recess 22 and will thus be oriented with respect to the transparent side (e.g. the front and back walls 12 and 14 as indicated earlier) of the housing. The juncture portion 24 of the bottom wall of the housing 6 joining the side walls of the chamber 4 to recess 22, is preferably tapered to guide the lowest apex of the body into recess 22 during the descent of the body.

The illustrated device may be used in the following manner: In its stable condition, with the housing resting on a flat horizontal surface such that chamber 4 is in its illustrated upright position, the geometric body 2 will have sunk to the bottom of the chamber with one of its 8 apices received within recess 22 of the chamber bottom. In this position, one viewing body 2 through the transparent front wall 12 of the housing, along the axis of the apex facing him would observe a 6-pointed star, this being a characteristic of the specific geometric configuration of body 2 as described earlier.

The user may pick up housing 6 and invert it momentarily so that body 2 moves away from the bottom of the housing, and may then return the housing to its normal upright position whereupon body 2 will slowly descend in the liquid within chamber 4 until its lowermost apex is guided by the tapered juncture portion 24 into recess 22 at the chamber bottom. During these movements of body 2, it comes into contact with the projections 20 protruding into chamber 4, which projections apply turning moments to the body, thereby causing the body to tumble and preventing it from remaining in its original orientation; thus, when body 2 finally descends back to the chamber bottom, it is likely that a different apex will be received within recess 22. However, whatever apex is received within recess 22, it will still present the appearance of a 6-pointed star.

Accordingly, the different faces of body 2 can be differently colored, so that different colors will be displayed in the different positions of the body. Alternatively, the different faces of the body can carry different messages such as advertising or promotional materials, which would be displayed according to the final resting position of the body.

Another variation would be to include small particles within the liquid in chamber 4, which small particles would produce a cloud obscuring body 2 when the housing is inverted and then returned to its original position, the small particles eventually settling to the bottom of the chamber with body 2 to permit the unobscured viewing of the body.

A still further variation would be to make the geometric body 2 of a density smaller than that of the liquid within the chamber, in which case the body would float within the chamber. In this variation, the top of the housing 6 would be constructed as illustrated in FIG. 3, wherein the top housing section 6*b*′ is formed with the recess 22′ adapted to receive the body apex, and also is formed with the tapered juncture portion 24′ for guiding the body apex into the recess. In such a construction, the geometric body would float at the top of housing section 6*b*′ with its apex received in recess 22′ in the normal upright position of the housing. If small particles are included (not shown), it would be preferable to make them of greater density than the liquid, so that the particles will settle below the geometric body in this normal upright position of the housing.

Another variation would be to form both ends of the housing with the recess (22,22′), so that both the top and bottom walls of the housing could serve as a base for stably supporting the device on a horizontal surface. The foregoing could be used in either of the above-described arrangements, i.e., when the body has a density greater than that of the liquid in the chamber so as to sink in the liquid, or has a density smaller than that of the liquid in the chamber so as to float, as described above.

A still further variation, particularly in the arrangement wherein the geometric body floats, is to include two immiscible liquids in the chamber, one of which liquids is colored and the other of which is clear, the colored liquid being of a higher density and therefore settling at the bottom, while the floating geometric body is visible through the clear liquid.

Body 2 could take other configurations, for example a simple tetrahedron, or two tetrahedra secured in face-to-face relationship. The outer configuration of the housing may also take different shapes, e.g., a cylindrical shape, but the illustrated prismatic shape is preferable to provide a stable support for the housing when resting on a horizontal surface.

The device may also be used as a random device with or without the dampening liquid, for playing various types of games, in which case the different faces of the geometric body would be differently marked as with different numbers, letters, words, pictures, symbols or the like.

FIG. 4 illustrates a still further variation, wherein the housing, generally designated 106, is configured to provide a planar side perpendicular to the axis of each of the eight apices of the geometric body, therein designated 102, so that the viewer will see a 6-pointed star in every position of the housing wherein his line of sight is perpendicular to one of the planar faces of the housing. Thus, housing 106 would be of hexagonal cross-section, including six planar faces 106*a*-106*f*, each perpendicular to the axis through each of the six points of the star (as indicated by Face 106*a* being perpendicular to axis 103*a* of apex 102*a*); and two additional planar end faces at the opposite ends perpendicular to the axes of the two opposed apices which are not seen in FIG. 4.

The housing configuration illustrated in FIG. 4 could be used with the previously described embodiments wherein the housing is formed with the chamber (e.g. 4) in which the geometric body is movable. FIG. 4, however, illustrates the further variation wherein such a chamber is omitted, and instead, geometric body 102 is embedded within housing 106. The latter is preferably made of a transparent plastic material so that the geometric body can be viewed through all eight sides of the housing. As in the previously-described embodiments, the different sides of the geometric body may be differently colored.

FIG. 5 illustrates a still further variation, wherein the geometric body 202 is embedded within a housing 206 having more than eight sides or faces. In this case, the housing has twelve planar sides or faces. Thus, the housing will stably support the geometric body in any one of twelve positions.

Further variations, modifications, and applications of the invention will be apparent.

What is claimed is:

1. An ornamental or amusement device, comprising: a housing formed with a closed internal chamber adapted to extend in the vertical direction when the housing is supported in an upright position; at least one side of said housing being transparent to permit viewing said chamber; said chamber being filled with a transparent liquid; a body disposed within said chamber and having the geometrical configuration of two inter-penetrating tetrahedra including eight apices and presenting the appearance of a six-pointed star when viewed along the axis of any one of said eight apices; the housing at one end of said chamber being formed with a recess corresponding to the shape of said apices; said body having a density different from that of said liquid such that inverting the housing from its upright position causes the body to move through said liquid away from said one end of the chamber to the opposite end, and then returning the housing to its upright position causes the body to move through said liquid back towards said one end of the chamber until one of the apices of said body is received within said recess formed in said one end of the chamber for orienting the body with respect to the transparent side of said housing; said chamber being of larger cross-sectional dimensions and height than the largest dimension of the geometric body so as to permit the geometric body to tumble when moving away from said one end of the chamber towards the opposite end.

2. The device according to claim 1, wherein said body has a density greater than that of said liquid, such that in the normal upright position of the housing, the body rests on the chamber bottom, said recess being formed in the bottom end of said housing.

3. The device according to claim 1, wherein said body has a density smaller than that of said liquid, such that in the normal upright position of the housing, the body floats at the top of the chamber, said recess being formed in the top end of said housing.

4. The device according to claim 1, wherein said housing is formed with said recess at both the bottom and top ends of said chamber.

5. The device according to claim 1, wherein said housing includes projections protruding into said internal chamber such as to engage said body during its movements for causing said body to tumble during such movements.

6. An ornamental or amusement device, comprising a geometric body having the configuration of two interpenetrating tetrahedra including eight apices and presenting the appearance of a six-pointed star when viewed along the axis of any one of said eight apices, and a housing enclosing said geometric body and having at least eight planar faces to enable the housing to stably support the geometric body in at least eight different stable positions for selectively viewing it along any one of the eight apices of the geometric body; said geometric body being embedded within said housing.

* * * * *